United States Patent [19]

Tausendfreundt et al.

[11] 4,203,208

[45] May 20, 1980

[54] BIASED POCKET KNIFE SCISSORS

[75] Inventors: Jay Tausendfreundt, Portsmouth; Albert Gentile, Warwick, both of R.I.

[73] Assignee: Imperial Knife Associated Companies, Inc., New York, N.Y.

[21] Appl. No.: 11,810

[22] Filed: Feb. 14, 1979

[51] Int. Cl.[2] ..... B26B 13/16

[52] U.S. Cl. ..... 30/155; 30/261

[58] Field of Search ..... 30/261, 262, 253, 155, 30/158

[56] References Cited

U.S. PATENT DOCUMENTS

| | | | |
|---|---|---|---|
| 515,828 | 3/1894 | Hayden | 30/155 X |
| 708,683 | 9/1902 | Wales | 30/261 |
| 1,186,235 | 6/1916 | Schrade | 30/261 X |
| 1,828,121 | 10/1931 | Adam | 30/155 X |
| 3,548,496 | 12/1970 | Van Hook | 30/253 |
| 3,861,038 | 1/1975 | Charles | 30/261 |

*Primary Examiner*—Jimmy C. Peters

*Attorney, Agent, or Firm*—Kirschstein, Kirschstein, Ottinger & Cobrin

[57] ABSTRACT

A scissors, preferably for use as one of the elements in a pocket knife such as a jackknife, which is biased to an open position by a concealed spring. The scissors includes two rectilinear blades which are pivotally secured to each other by a pivot at a point intermediate the ends of the blades. The blades are biased to open position in which the blades are at an acute angle to each other by the spring, which is mounted about the pivot. The spring includes a single flat coil which spans an arc of less than 360°, typically 270°. One end of the coil has an integral leg perpendicular to the plane of the coil and parallel to and adjacent the pivot. The other end of the coil extends tangentially away from the arc of the spring coil. One of the blades has a pocket, including an extension, adjacent the pivot. The other blade also has a pocket adjacent the pivot, and the leg is located in this pocket. The spring is disposed in the pockets with the coil of the spring extending about the pivot. The other end of the coil, in conjunction with the leg, biases the blades to an open position, with the other end of the coil bearing against a side of the extension of the first-mentioned pocket. The leg acts as an anchor in this regard.

6 Claims, 4 Drawing Figures

FIG. 1
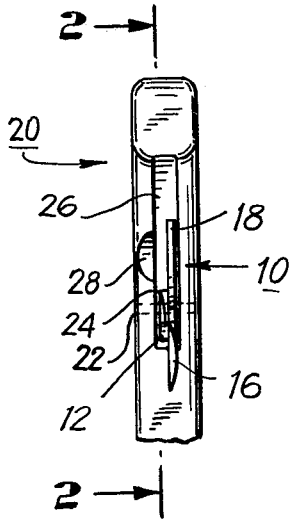
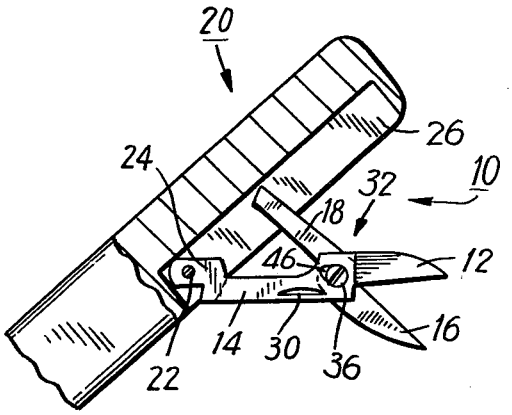
FIG. 2
FIG. 3
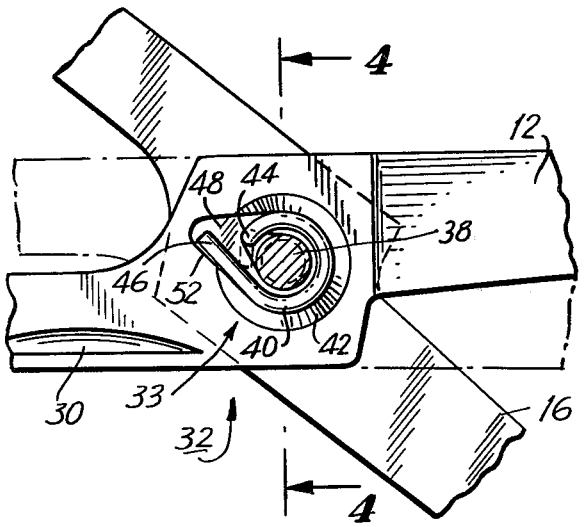
FIG. 4
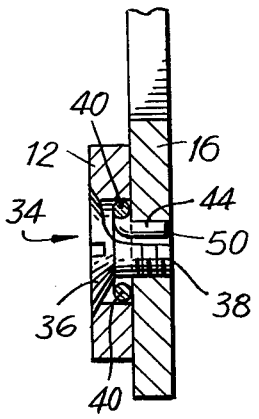

BIASED POCKET KNIFE SCISSORS

BACKGROUND OF THE INVENTION

1. Field of the Invention

A scissors which is spring-biased to an open position.

2. Description of the Prior Art

In the scissors art, it is useful for many applications to have an integral means in the scissors for biasing the scissors to an open position. Thus, in the case of a pocket knife such as a jackknife having a scissors as one of the elements mounted to or in the knife, a biasing means is commonly employed. In this surrounding, the scissors has one blade connected to a pivot in the frame of the jackknife, so that this blade can be swung between a position in which it is retracted into the frame, and a position in which it extends from the frame. The aforesaid one blade is pivoted at the shank or tang end thereof. The one blade has pivotally secured to it a second blade. The point of pivoted connection between the two blades is intermediate the ends of the blades. When the first blade is in retracted position within the frame of the knife, the second blade likewise is in a similar retracted position. However, when the first blade is swung out of the knife, it is desirable to have the second blade swing away from the first blade, so that the scissors assumes an open position. The reason that this is preferred is that neither blade has a finger engaging handle. Hence, the blades can only be readily manipulated so as to swing them into closed position. They cannot be manipulated readily to swing them to open position. Thus, it is desirable that the blades include means to bias them to open position, and jackknife scissors conventionally have such a biasing means, typically a spring integral with the scissors, to bias the blades open. The same principle is used with blades other than scissors blades in a jackknife, in order to bias the blades apart. For example, a poultry shears has a spring to bias the blades apart. This spring normally is located in the angle between the blades near the fulcrum where it is highly visible. The spring-biasing principle to keep blades apart is also employed in clippers, e.g. fingernail or toenail clippers, and in sheet metal shears. In all of the instances mentioned supra, it is desirable to provide a concealed biasing spring both for esthetic purposes and also because of the long history of spring breaking problems with the old fashioned leaf spring scissors. Thus the general idea of a hidden or semi-hidden spring engaging special recesses at the pivot of a scissors has been suggested. Typical pertinent prior art in this regard includes U.S. Pat. Nos. 663,565; 908,947; 1,814,821; 2,261,679; 2,392,118; 2,512,862; 2,597,519; 3,057,063; 3,834,022 and 3,861,038.

SUMMARY OF THE INVENTION

1. Purposes of the Invention

It is an object of the present invention to provide an improved scissors.

Another object is to provide a scissors which is biased to an open position.

A further object is to provide a scissors which is biased to an open position by a concealed spring means.

An additional object is to provide an improved biased pocket knife scissors.

Still another object is to provide an improved scissors which is spring-biased to an open position.

Still a further object is to provide a scissors which can be pivotally mounted in the frame of a pocket knife, and which has a concealed or semi-hidden spring for biasing the blades to an open position.

Still another object is to provide a scissors which is spring-baised to the open position by a concealed spring mounted in a pocket at the pivot of the blades, the spring and pocket being of specific and unique configuration.

Another object is to obviate the necessity of drilling or punching a minute hole in the blade of a pocket knife scissors in order to mount a biasing spring thereto.

An object is to provide an improved configuration of biasing spring in conjunction with recesses or pockets in the blades (at the pivot point) in a spring-biased scissors.

An object is to provide a spring-biased scissors in which the possibility of spring breakage is greatly diminished.

These and other objects and advantages of the present invention will become evident from the description which follows.

2. Brief Description of the Invention

In the present invention, the biased pocket knife scissors is a pair of blades with a spring that biases them to open position. The scissors is preferably adapted to constitute one of the tools forming part of a pocket knife such as a jackknife. When the tool is swung into closed position and retracted into the frame of the pocket knife, the blades are closed. The spring biases the blades open when the tool is swung out to a position in which it extends from the frame of the pocket knife.

The spring is of a special and unique configuration constituting a single flat coil which spans an arc slightly less than 360°, and preferably about 270°. One end of the coil is turned into a leg that is 90° to the plane of the coil. The other end of the spring extends tangentially away from the arc. The spring is received in a pocket surrounding the central opening in one of the blades, through which opening extends the screw or other pivot means that joins the two blades. The spring is concealed in the tool. This is an important aspect of the invention, i.e. the concept of having the spring totally concealed is contemplated. More particularly, to this end the first blade of the scissors is provided with a pocket in which a wire spring is seated. The spring has an end pin or leg which is received in a blind well in the pocket to anchor this end of the spring. The other end of the spring biases against a wall of the pocket so as to urge the blades apart. The blades are secured to one another for pivotal motion by a screw or the like. The principle of the present invention can, of course, be used with blades other than scissors blades in a jackknife in order to bias the blades apart. Thus the principle of the invention is used to at least semiconceal the spring in a scissors or the like which is biased to an open position by a spring means. One facet of the present invention is the fact that a hidden or semi-hidden spring engages special recesses at the pivot.

One problem that has been solved by the present invention, with specific regard to a pocket knife scissors with concealed spring, is that of putting a hole about 0.018" in diameter into a piece of stainless steel approximately 0.050" thick.

There are several possible ways of doing this; however, in the present invention, a way has been found to make the scissors without the small hole. What has been evolved is the concept of a pocket which includes an extension, e.g. a tear drop shaped pocket. With the tear drop shapes the size of those adopted for the blades of a pocket knife scissors, it is possible to make all of the necessary holes as stages in a progressive blanking tool.

In addition to solving the small hole problem, the present scissors is so designed that both blades can be made from the same blanking tool. This is done by blanking the one blade with one punch and die for the larger tear drop hole; and, upon completion of blanking the one blade, changing the punch and die in this tool for the tear drop, and then blanking the other blade with the smaller tear drop. The other blade is then put through a secondary operation in which the tang of the blade is cut off, and is welded to the tang of the one blade to give the proper spacing and clearance, so that the scissors will fit the knife.

In summary, the present invention is a scissors biased to an open position by a concealed spring means. The scissors includes first and second rectilinear blades and a pivot means. The first blade is pivotally secured to the second blade at a point intermediate the ends of the blades by the pivot means. Means is provided for biasing the blades to open position, in which the blades are at an acute angle to one another. The biasing means includes a spring means mounted about the pivot means. The spring means includes a single flat coil which spans an arc of slightly less than 360°. One end of the coil has an integral leg generally perpendicular to the plane of the coil. The leg is parallel to and adjacent the pivot means. The other end of the coil extends tangentially away from the arc of the spring means. One of the blades has a pocket adjacent the pivot means. The pocket includes an extension, and in a preferred embodiment this pocket is typically tear drop shaped. The other of the blades has a pocket adjacent the pivot means, and the leg is located in this pocket. The spring means is thus disposed in the pockets, with the coil of the spring means extending about the pivot means. The other end of the coil, in conjunction with the leg, biases the blades to the open position, with the other end of the coil bearing against a side of the aforementioned extension in the first named pocket. The leg or pin acts as an integral anchor in this regard.

Typically, the pivot means is a screw with a threaded shank, and at least one of the blades has a threaded opening at the pivot point to receive this shank. Preferably the single flat coil spans an arc of about 270°. As mentioned supra, in a preferred embodiment, the scissors is a tool mounted in a pocket knife such as a jackknife. In this case, the tang or shank of one of the blades is pivotally mounted in the frame of the pocket knife, so that this blade can be swung between a position in which it is retracted into the frame, and a position in which it extends from the frame.

The present spring-biased scissors configuration provides several salient advantages. The likelihood of spring breakage during extended service and usage is greatly lessened. The spring is concealed or semi-hidden. The elements are simply and easily fabricated and manufactured, and fabrication and assembly of the unit does not require any special or costly tools or dies, and thus the present spring-biased scissors can be mass produced at low cost to the consumer. The necessity of drilling or punching a minute hole in the blade of a pocket knife scissors, in order to mount a biasing spring thereto, has now been obviated. The present scissors provides an improved tool for a pocket knife, and increases the utility of pocket knives such as jackknifes. Thus, a new and improved mode of spring-biasing a scissors to the open position has been provided.

The invention, accordingly, consists in the features of construction, combination of elements and arrangement of parts which will be exemplified in the device and article of manufacture hereinafter described and of which the scope of application will be indicated in the appended claims.

BRIEF DESCRIPTION OF THE DRAWINGS

In the accompanying drawings in which is shown one of the various possible embodiments of the invention:

FIG. 1 is an elevation view of the present scissors as mounted to the frame of a pocket knife;

FIG. 2 is a sectional elevation view taken substantially along the line 2—2 of FIG. 1;

FIG. 3 is an enlarged elevation view of the pivot region where the blades cross, in the scissors of FIG. 2; and FIG. 4 is a sectional elevation view taken substantially along the line 4—4 of FIG. 3.

DETAILED DESCRIPTION OF THE PREFERRED EMBODIMENTS

Referring now to the Figures, the present scissors 10 has a first rectilinear blade 12 having a shank or tang 14 and a second rectilinear blade 16 having a shank or tang 18. The scissors 10, as seen in FIGS. 1 and 2, is mounted to the frame 20 of a pocket knife via the pivot 22 which extends at the terminus 24 of the shank 14, so that the knife 10 when folded and closed fits into a recess 26 in the frame or handle 20 of the pocket knife. As seen in FIG. 2, the terminus 24 of the shank 14 is of a double thickness; as discussed supra, this double thickness is attained by prior cutting off of the end of the shank 18, both blades 12 and 16 having been formed via the same blanking tool, with the cut off end of the shank or tang 18 having been welded to the end of the shank or tang 14, both ends being of identical shape.

The frame 20 has a recess, notch or curved opening 28 (FIG. 1) to accommodate a finger of the user so that the scissors 10 may be swung or pulled out of the recess 26 in the frame 20 by inserting a fingernail into a groove 30 in the face of the shank 14 and manipulating by swinging, i.e. pulling, the scissors 10 out of the recess 26. Concomitantly, as seen in FIG. 2, the scissors 10 has sprung into the open position because of the integral spring biasing to be described infra.

The first blade 12 is pivotally secured to the second blade 16 at a point 32 intermediate the ends of the blades by a pivot means generally designated as 33 and consisting in this instance of a screw 34 having a slotted head 36 and a threaded shank 38 (FIG. 4). The blade 16 has a threaded opening at the pivot point 32 to receive the shank 38.

Spring means is provided for biasing the blades 12 and 16 to the open position as shown in FIG. 2; this spring biasing means is mounted about the pivot means 33 and includes a single flat coil 40 which spans an arc of slightly less than 360°; in this embodiment, the arc is about 270° (FIG. 3). As shown in FIG. 3, the coil 40 extends about the shank 38 of the screw 34. A chamfer 42 (FIG. 3) is provided in the blade 12 to accommodate the head 36 of the screw 34. The inner edge of this chamfer 42 defines most of the periphery of the pocket in the blade 12. One end of the coil 40 has an integral leg 44 generally perpendicular to the plane of the coil 40, as best seen in FIG. 4. The leg 44 is parallel to and adjacent the shank 38 of the screw 34, said screw 34 constituting a preferred pivot means. The other end 46 of the coil 40, as best seen in FIG. 3, extends tangentially away from the arc of the coil 40. As seen in FIG. 3, the first blade 12 has a tear drop shaped pocket adjacent and about the pivot means 33, the extension 48 of the pocket providing the tear drop shape. The other blade 16 also has a pocket 50 adjacent the pivot means 33 (screw 34). As shown in FIG. 4, the leg 44 is located in the pocket 50. Thus the spring means consisting generally of elements 40, 44 and 46 is disposed in the pockets, with the coil 40 of the spring means extending about the pivot means (shank 38, FIG. 3). The other end 46 of the coil 40, in conjunction with the anchor leg 44, biases the blades 12 and 16 to the open position, as can best be seen in FIGS. 3 and 4. The other end 46 of the coil 40 bears against a side 52 of the extension 48 of the pocket in the blade 12 (FIG. 3). The leg or pin 44 acts as an anchor in this regard.

As can be seen from FIGS. 2 and 4, the spring means in the present spring-biased scissors is virtually completely concealed and hidden from view, both by the head 36 of the screw 34 and also, on the opposite side, by virtue of the fact that only the tip end of the leg 44 is visible in the pocket 50 (FIG. 4).

It thus will be seen that there is provided a device and article of manufacture which achieves the various objects of the invention and which is well adapted to meet the conditions of practical use.

As various possible embodiments might be made of the above invention, and as various changes might be made in the embodiment above set forth, it is to be understood that all matter herein described or shown in the accompanying drawings is to be interpreted as illustrative and not in a limiting sense. Thus, it will be understood by those skilled in the art that although a preferred embodiment has been shown and described in accordance with the Patent Statutes, the invention is not limited thereto or thereby.

Having thus described the invention, there is claimed as new and desired to be secured by Letters Patent:

1. A scissors biased to an open position by a concealed spring means which comprises a first rectilinear blade, a second rectilinear blade, pivot means, said first blade being pivotally secured to said second blade at a point intermediate the ends of said blades by said pivot means, and means for biasing said blades to open position in which said blades are at an acute angle to one another, said biasing means including a spring means mounted about said pivot means, said spring means comprising a single flat coil which spans an arc of slightly less than 360°, one end of said coil having an integral leg substantially perpendicular to the plane of the coil, said leg being parallel to and adjacent said pivot means, the other end of said coil extending tangentially away from the arc of the spring means, one of said blades having a pocket adjacent said pivot means, said pocket including an extension, the other of said blades having a pocket adjacent said pivot means, said leg being located in said second named pocket, said spring means being disposed in said pockets with the coil of said spring means extending about said pivot means, and the other end of said coil in conjunction with said leg biasing said blades to said open position, said other end of said coil bearing against a side of the extension in said first named pocket.

2. The scissors of claim 1 in which the pivot means is a screw with a threaded shank, and at least one of the blades has a threaded opening at the pivot point to receive said shank.

3. The scissors of claim 1 in which the single flat coil spans an arc of about 270°.

4. The scissors of claim 1 in which the tang of one of the blades is pivotally mounted in the frame of a pocket knife, so that this blade can be swung between a position in which it is retracted into the frame, and a position in which it extends from the frame.

5. The scissors of claim 4 in which the pocket knife is a jackknife.

6. The scissors of claim 1 in which the first pocket is tear drop shaped.

* * * * *